US005744072A

United States Patent [19]

Karliner

[11] Patent Number: 5,744,072

[45] Date of Patent: Apr. 28, 1998

[54] METHOD OF TREATING WASTE WATER

[75] Inventor: Rudolf R. Karliner, Minnetonka, Minn.

[73] Assignee: Aeration Industries International, Inc., Chaska, Minn.

[21] Appl. No.: 642,445

[22] Filed: May 3, 1996

[51] Int. Cl.[6] ..... B01F 3/04

[52] U.S. Cl. ..... 261/87; 261/120; 210/242.2; 114/352

[58] Field of Search ..... 261/120, 87; 210/242.2; 114/352, 266

[56] References Cited

U.S. PATENT DOCUMENTS

| | | | |
|---|---|---|---|
| 2,314,624 | 3/1943 | Macaulay | 114/352 |
| 2,453,155 | 11/1948 | Nelson et al. | 114/352 |
| 2,876,726 | 3/1959 | Robishaw | 114/266 |
| 3,349,415 | 10/1967 | Scholle | 114/352 |
| 3,400,918 | 9/1968 | MacLaren | 261/87 |
| 3,478,710 | 11/1969 | Bethurem | 114/266 |
| 3,650,513 | 3/1972 | Werner | 261/87 |
| 3,755,142 | 8/1973 | Whipple, Jr. | 210/63 |
| 4,240,990 | 12/1980 | Inhofer et al. | 261/87 |
| 4,280,911 | 7/1981 | Durda et al. | 210/629 |
| 4,587,064 | 5/1986 | Blum | 210/242.2 |
| 4,741,825 | 5/1988 | Schiller | 210/170 |
| 4,741,870 | 5/1988 | Gross | 261/93 |
| 4,774,031 | 9/1988 | Schurz | 261/87 |
| 4,806,251 | 2/1989 | Durda | 210/747 |
| 4,844,816 | 7/1989 | Fuchs et al. | 210/758 |
| 4,844,843 | 7/1989 | Rajendren | 261/30 |
| 4,954,295 | 9/1990 | Durda | 261/16 |
| 5,110,510 | 5/1992 | Norcross | 210/242.2 |
| 5,116,501 | 5/1992 | House | 261/120 |
| 5,160,667 | 11/1992 | Gross et al. | 261/91 |
| 5,312,567 | 5/1994 | Kozma et al. | 261/87 |

FOREIGN PATENT DOCUMENTS

| | | | |
|---|---|---|---|
| 955879 | 4/1964 | United Kingdom | 210/242.2 |

*Primary Examiner*—Tim R. Miles

*Attorney, Agent, or Firm*—Nawrocki, Rooney & Sivertson

[57] ABSTRACT

Apparatus and a process for use in aeration of a fluid. The apparatus includes a tubular drive shaft having a first end and a second end. The first end is coupled to a selectively rotatable power source. A compressed air source is in fluid communication with the tubular drive shaft. A first propeller having a propeller shaft is coupled to the second end of the tubular drive shaft. An atomizing mechanism is located proximate the propeller shaft. The apparatus may further include a second propeller having a propeller shaft positioned between the first propeller and the second end of the tubular drive shaft. In another mode of operation, the aerator may be used solely as a mixer in an nitrification/denitrification process without the introduction of outside air or compressed air.

3 Claims, 5 Drawing Sheets

METHOD OF TREATING WASTE WATER

BACKGROUND OF THE INVENTION

The present invention relates to an aerator for treatment of fluid. More particularly, the present invention relates to an air assisted propeller aerator apparatus which efficiently mixes and improves the dissolved oxygen content in a fluid.

Aeration processes are utilized in the treatment of fluid for the purpose of mixing and increasing the dissolved oxygen (DO) content of the fluid. When used in a waste water treatment process, bacteria and other micro-organisms are supplied with oxygen to breakdown organic matter within the waste water in a purification process. In other applications, aeration processes are used in the treatment of water to meet the dissolved oxygen requirements for supporting fish life and other aquatic organisms.

Known aeration apparatuses include surface aerators, diffuser/blowers, and rotor aerators. Surface aerators pump water upward and throw the water into the air. Surface aeration systems require high horse power and consume high amounts of energy in pumping water against the force of gravity. In blower/diffuser systems, compressed air is introduced through diffusers at the bottom of a basin. Higher horse power is required to overcome the water head resistance. Oxygen rises vertically and escapes quickly before effective dispersion into the water can take place. Rotor aerators consist of rotating aerators positioned at the surface of the water receiving treatment. Rotor systems have been known to be expensive to maintain and are high in energy consumption. They cast water into the air, creating an aerosol environment which releases offending odors into the air.

Another known type of aeration apparatus is a aspirator type aerator. These devices use an electrical motor driven rotating propeller disposed below the surface of the substance being treated. The propeller draws in atmospheric air from an intake port through a draft tube and discharges it into the substance, e.g., the waste water being treated or the water containing marine life. Propeller type aerators may be operated generally horizontally, creating a horizontal rather than vertical flow pattern within a treatment basin.

Known propeller type aeration apparatus include Inhofer et al., U.S. Pat. No. 4,240,990 (Aeration Propeller and Apparatus); Durda et al., U.S. Pat. No. 4,280,911 (Method for Treating Water); Schiller, U.S. Pat. No. 4,741,825 (Mobile Vortex Shield); Schurz, U.S. Pat. No. 4,774,031 (Aerator); Durda, U.S. Pat. No. 4,806,251 (Oscillating Propeller Type Aerator Apparatus and Method); Fuchs et al., U.S. Pat. No. 4,844,816 (Method of Aeration at Specific Depth and Pressure Conditions); Rajendren, U.S. Pat. No. 4,844,843 (Waste Water Aerator having Rotating Compression Blades); Gross, U.S. Pat. No. 4,741,870 (Apparatus for Treatment of Liquids); and Durda, U.S. Pat. No. 4,954,295 (Propeller Aerator with Peripheral Injection of Fluid and Method of Using the Aerator).

The above known aerators require high speed propellers to create the vacuum for drawing in atmospheric air from an intake port and discharging it into the substance. Accordingly, these known aerators use high amounts of energy to create the vacuum.

SUMMARY OF THE INVENTION

The present invention is an apparatus for use in aeration/mixing of a fluid. In particular, the present invention relates to an air assisted propeller (aspirator) aerator apparatus which efficiently mixes and improves the dissolved oxygen content in a fluid.

In one embodiment, the apparatus includes a tubular drive shaft having a first end and a second end, wherein the first end is coupled to a selectively rotatable power source. A compressed air source is in fluid communication with the tubular drive shaft. A first propeller having a propeller shaft is coupled to the second end of the tubular drive shaft. An atomizing mechanism is located proximate the propeller shaft.

The atomizing mechanism may be coupled to the propeller shaft. The atomizing mechanism may further comprise a plurality of generally flat members spaced radially about the end of the propeller shaft, extending longitudinally outward from the end of the shaft. The generally flat members may extend inward towards the central longitudinal axis of the shaft.

The apparatus may further include a second propeller having a propeller shaft, positioned between the first propeller and the second end of the tubular drive shaft. The second propeller may be larger than the first propeller. A spacer may be located between the first propeller and the second propeller.

The atomizing mechanism may be constructed integral with the first propeller. A generally tubular housing may cover the tubular drive shaft. The generally tubular housing may have an opening. The compressed air source may be coupled to the opening. An air intake hole may be located along the tubular drive shaft, in fluid communication with the opening.

In yet another embodiment, the present invention includes a float support apparatus for supporting an aeration apparatus. The float support apparatus may include a generally U-shaped float base having a deck area, and a support frame for supporting an aeration apparatus from the float base.

The float base may be constructed from two symmetrically shaped sides, connected together. The float base may be constructed of a metallic frame filled with foam. The support frame may further include mounting brackets for adjustably suspending the aeration apparatus over the opening in the U-shaped float base.

BRIEF DESCRIPTION OF THE DRAWINGS

Many of the attendant advantages of the present invention will be readily appreciated as the same become better understood by reference to the following detailed description when considered in connection with the accompanying drawings in which like reference numerals designate like parts throughout the figures thereof, and wherein.

DETAILED DESCRIPTION OF THE PREFERRED EMBODIMENTS

Figure 1:
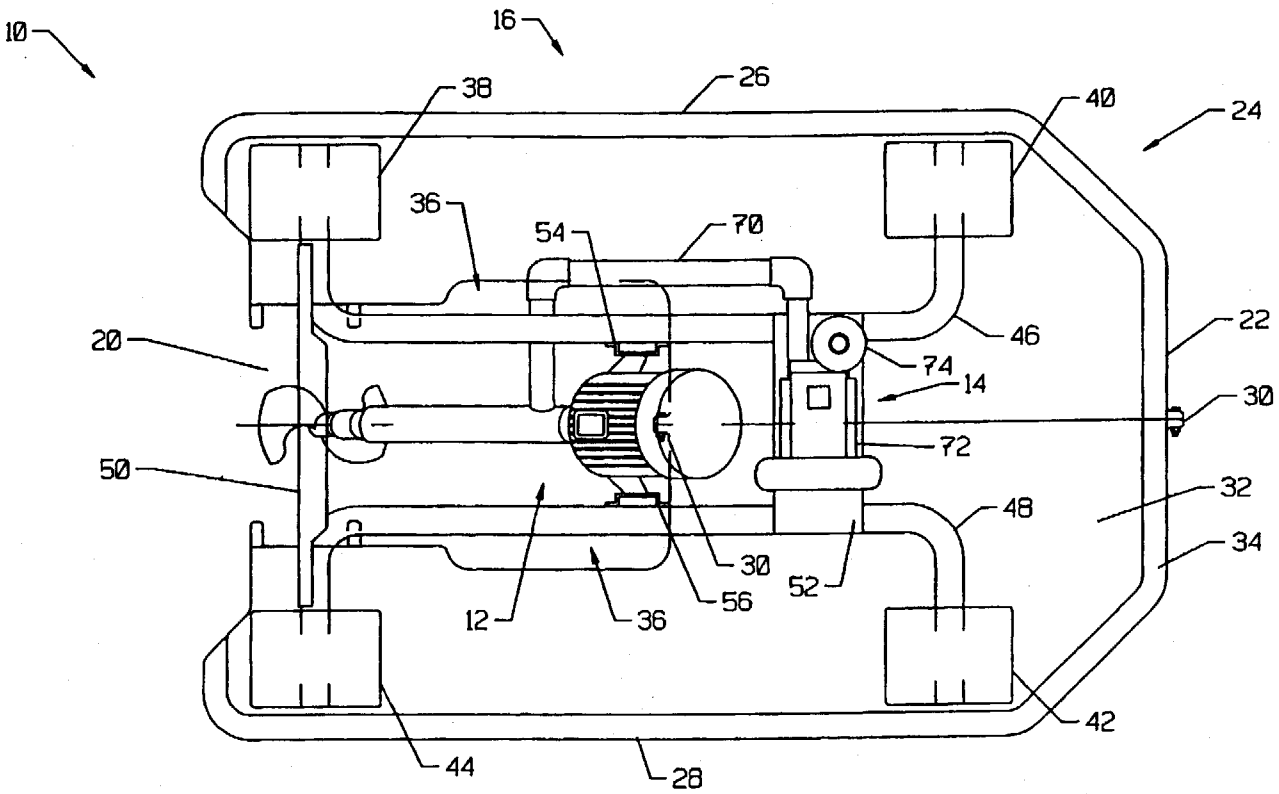
FIG. 1 is a top view of the aeration apparatus in accordance with the present invention.

FIG. 1 shows an aeration system in accordance with the present invention generally at 10. Aeration system 10 includes aerator 12 coupled to compressed air source 14. Aerator 12 and compressed air source 14 are coupled to and supported by float support structure 16. Aeration system 10 provides for efficient mixing and/or aeration of water for improving the dissolved oxygen content of the water in a water treatment system.

In one embodiment, float support structure 16 includes a generally U-shaped float base 24 having an open end 20 and a closed end 22. The uniquely shaped support structure allows operation of aerator 12, while providing a platform for personnel during maintenance and testing of the aeration system.

The float base 24 is constructed of a metallic or non-metallic frame which is filled with foam. In one embodiment, the frame is metallic. The float base 24 may be manufactured in halves, shown as first half 26 and second half 28. The first half 26 and second half 28 are generally symmetrical in size and shape, and may be secured together at bolted connections 30 to form the generally U-shaped float base 24.

Float base 24 includes deck 32 which has an area suitable for stable support of personnel during testing or maintenance of the aeration equipment. The deck 32 is enclosed by a relatively small knee wall 34, extending up from deck 32, and located about its outside perimeter. The shape of deck 32 corresponds to the shape of float base 24 allowing free access to equipment supported by support structure 16.

Secured to deck 32 is mounting frame 36 for mounting aeration equipment on support structure 16. In particular, mounting frame 36 includes mounting bracket 38, mounting bracket 40, mounting bracket 42, and mounting bracket 44 secured to deck 32. Tubular support member 46 extends between and is fixedly secured at its ends to mounting bracket 38 and mounting bracket 40. Tubular support member 48 extends between and is fixedly secured at its ends to mounting bracket 42 and mounting bracket 44. Stabilizing bracket 50 is connected between tubular support member 46 and tubular support member 48 proximate the open end 20 of support structure 16, providing structural integrity to mounting frame 36. Compressor mounting plate 52 is connected between tubular support member 46 and tubular support member 48 proximate the closed end 22 of support structure 16. Compressor mounting plate 52 supports compressed air source 14 and provides further stabilization to support structure 16.

Extending proximate the center of tubular support member 46 is motor mounting bracket 54, and extending proximate the center of tubular support member 48 is motor mounting bracket 56. Motor mounting bracket 54 and motor mounting bracket 56 allow aerator 12 to be movably suspended over the generally rectangular opening in float base 24.

Figure 2:
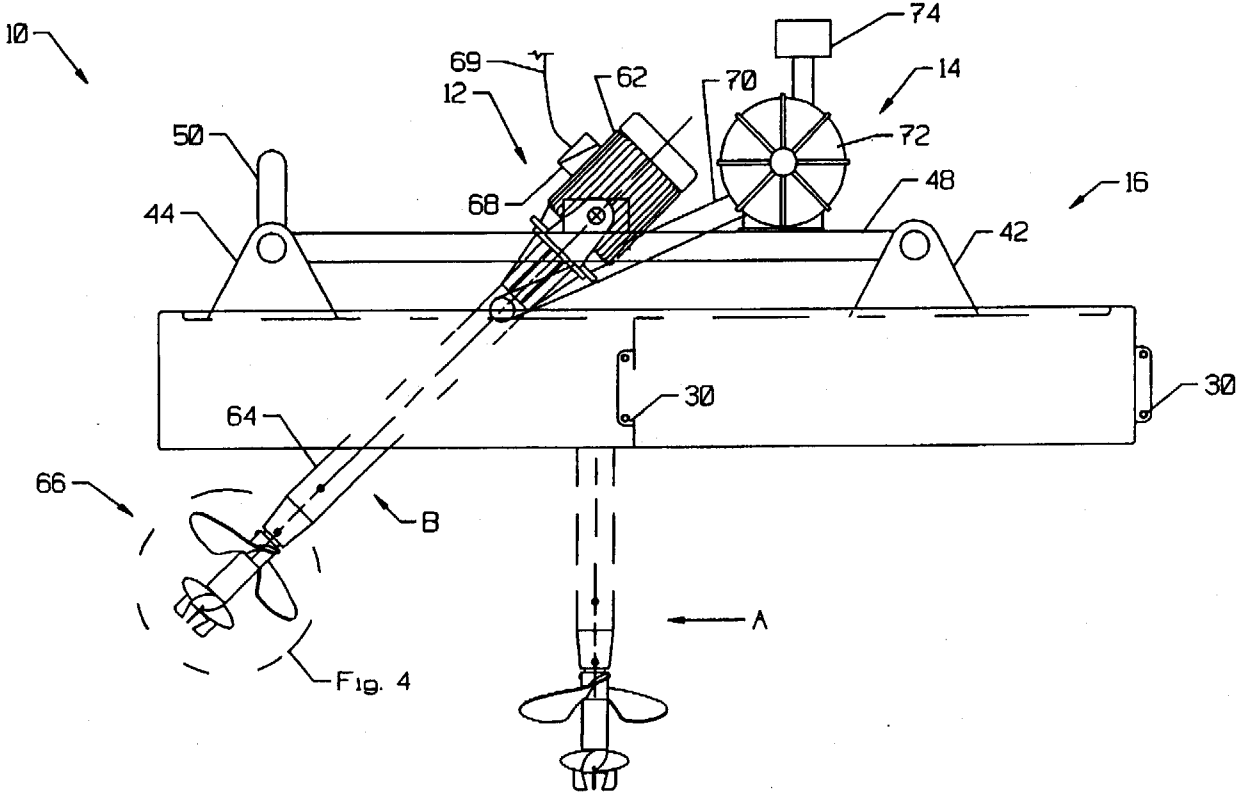
FIG. 2 is a side elevational view of the aeration apparatus shown in FIG. 1.

Referring to FIG. 2, a side elevational view of aeration system 10 is generally shown. Aerator 12 is rotatably coupled to support structure 16 (using motor mounting bracket 54 and motor mounting bracket 56). In this configuration, aerator 12 may be movably/selectively mounted between a generally vertical position A and a generally horizontal position (not shown). Aerator 12 is also shown in an intermediate position B. Aerator 12 may be pulled up into a generally horizontal position (and supported from stabilizing bracket 50) allowing maintenance to be performed on the aerator 12.

Figure 3:
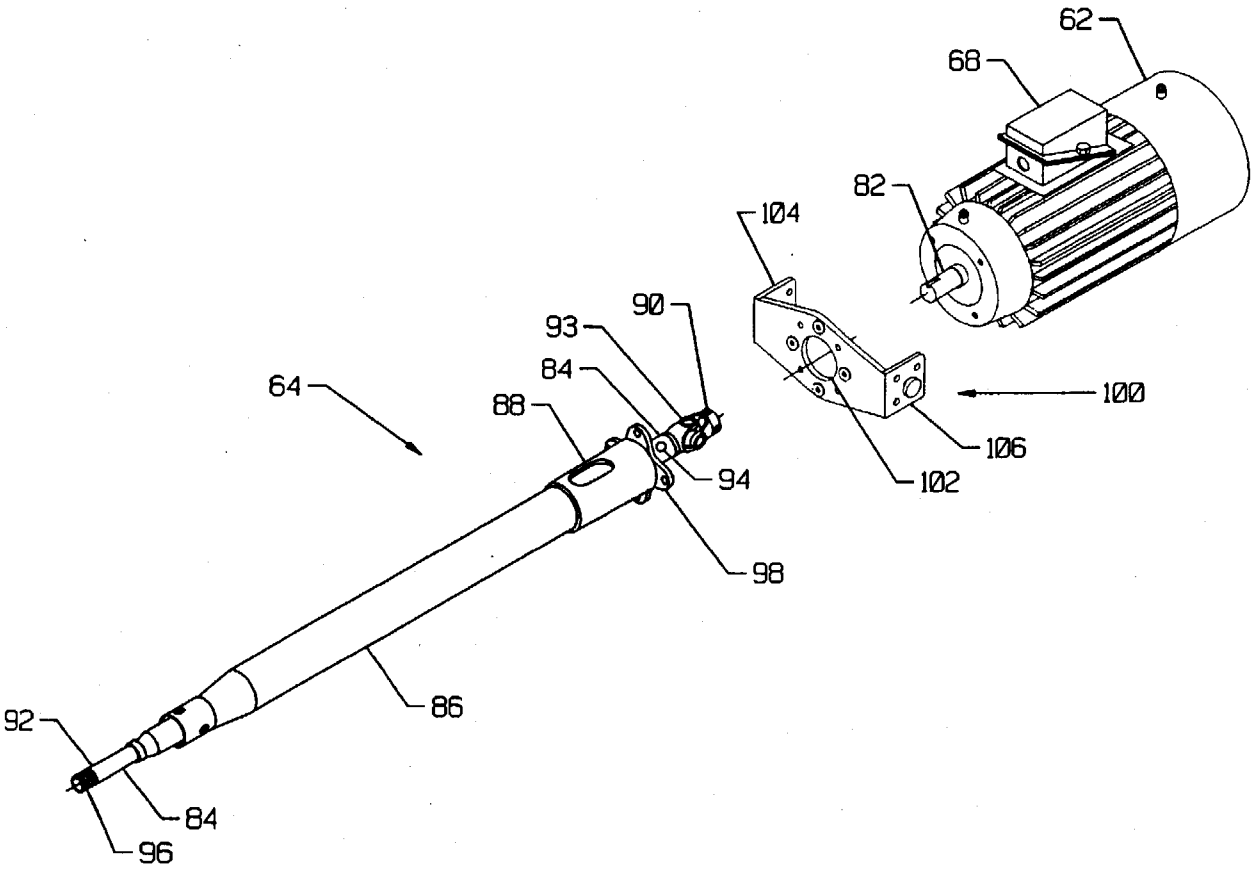
FIG. 3 is a partial perspective view showing the motor and shaft assembly of the aeration apparatus of FIG. 1.

Aerator 12 generally includes a motor 62 coupled to a shaft system 64 which, during operation, extends below support structure 16. Coupled to the end of shaft system 64 is propeller system 66. In one embodiment, motor 62 is an electric motor having electrical box 68 for connection to an electrical power source (not shown), indicated at 69. The shaft system 64 is coupled to the compressed air source 14 using flexible air hose 70. With this flexible connection, aerator 12 may be moved or positioned between the generally vertical position A and the generally horizontal position while maintaining the connection to compressed air source 14. In one embodiment, compressed air source 14 is an electric powered air compressor having a motor 72 and an air system 74 extending above the motor 72. Air compressor motor 72 is coupled to an electrical power source (not shown). Referring to FIG. 3, a perspective view of the motor 62 and corresponding shaft system 64 is shown. In one embodiment, motor 62 is an electric motor, which may typically range in power between 1 and 100 horsepower. It is also recognized that motor 62 may be much larger than 100 horsepower. Motor 62 has a rotatable power shaft 82 extending therefrom.

Shaft system 64 includes a drive shaft 84 positioned within housing 86. Housing 86 includes compressed air opening 88, which, when assembled, is in communication with compressed air source 14 through flexible air hose 70. Drive shaft 84 is rotatably positioned within housing 86. Drive shaft 84 is a generally tubular member, and includes a first end 90 and a second end 92. Located at the first end 90 is a universal joint 93. Extending into the interior of the shaft 84 is air intake hole 94. In one preferred embodiment, air intake hole 94 is located proximate the drive shaft first end 90. It is also recognized that shaft 84 may include several air intake holes 94. The drive shaft second end 92 includes threads 96 for connection to propeller system 66.

The shaft system housing 86 includes a flange 98 which is bolted to the casing of motor 62 through mounting plate 100. The first end 90 of drive shaft 84 extends through an opening 102 in mounting plate 100, and is coupled to the motor rotatable power shaft 82. Mounting plate 100 further includes extension 104 for rotatable connection to motor mounting bracket 54 and extension 106 for rotatable connection to motor mounting bracket 56.

When assembled, the drive shaft air intake hole 94 generally aligns with housing compressed air opening 88. As drive shaft 84 is rotated about its longitudinal axis, compressed air may pass through compressed air opening 88, and access the hollow shaft of drive shaft 84 through air intake hole 94, exiting drive shaft second end 92.

Figure 4:
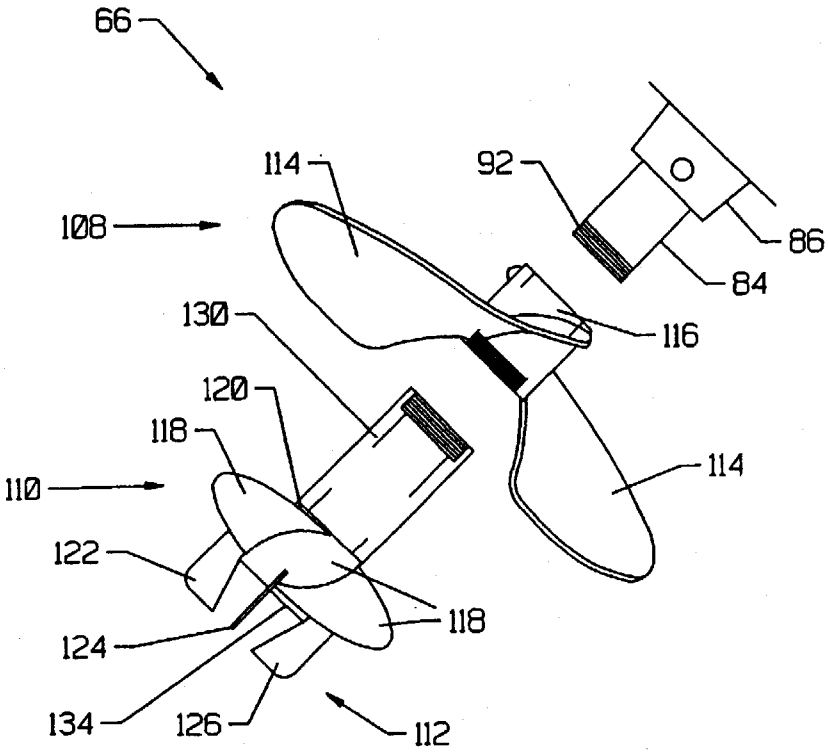
FIG. 4 is an enlarged side view of the propeller system of the aeration apparatus of FIG. 1.

Referring to FIG. 4, an enlarged assembly view of the propeller system 66 is shown. Propeller system 66 includes primary propeller 108, secondary propeller 110, and atomizer 112. Primary propeller 108 includes primary blades 114 extending outward from a hollow primary propeller hub 116. The primary propeller shaft 116 is sized to fit over drive shaft second end 92. In one embodiment, the primary propeller 108 is similar to a standard ship propeller.

Similar to the primary propeller 108, secondary propeller 110 includes secondary propeller blades 118 extending outward from secondary propeller shaft 120. The secondary propeller blades 118 are small relative to primary propeller blades 114. Atomizer 112 is located proximate the secondary propeller 110. In one embodiment, atomizer 112 includes atomizer fin 122, atomizer fin 124, atomizer fin 126, and atomizer fin 128 (not shown) extending longitudinally from one end of secondary propeller 110, and are spaced radially about the shaft 120. As atomizer fins 122–128 extend beyond propeller shaft 120, the atomizer fins extend inward towards the central longitudinal axis of the shaft 120, to a location which is farther inward than the interior opening of the secondary propeller shaft 120.

In assembly, primary propeller 108 is positioned over the drive shaft second end 92, and is coupled to the drive shaft 84. Spacer 130 is partially positioned over the drive shaft second end 92 and tightened against the primary propeller shaft 116. In one embodiment, spacer 130 is screwed tight onto the drive shaft second end 92, against primary propeller shaft 116. Similar to drive shaft 84, spacer 130 is a tubular member having an interior diameter which is approximately equal to the interior diameter of drive shaft 84 and an outside diameter which is approximately equal to the outside diameter of primary propeller shaft 116. Connected to an opposite end of spacer 130 is secondary propeller 110. The length of spacer 130 corresponds to the distance it is desired to space the secondary propeller from the primary propeller 108 to achieve a desired propeller performance. In one embodiment, the secondary propeller 110 is coupled to spacer 130 by bonding the secondary propeller shaft 120 to the end of spacer 130.

Atomizer 112 is located at an opposite end of secondary propeller 110. In one embodiment, the atomizer 112 atomizer fins 122–128 are formed integral the secondary propeller 110. It is recognized that atomizer 112 may also be formed as a separate unit and secured to the end of the secondary propeller shaft 120 or separated from the end of secondary propeller shaft 120 by an additional spacer, depending on the size of secondary propeller 110 and the desired propeller system performance characteristics.

Figure 5:
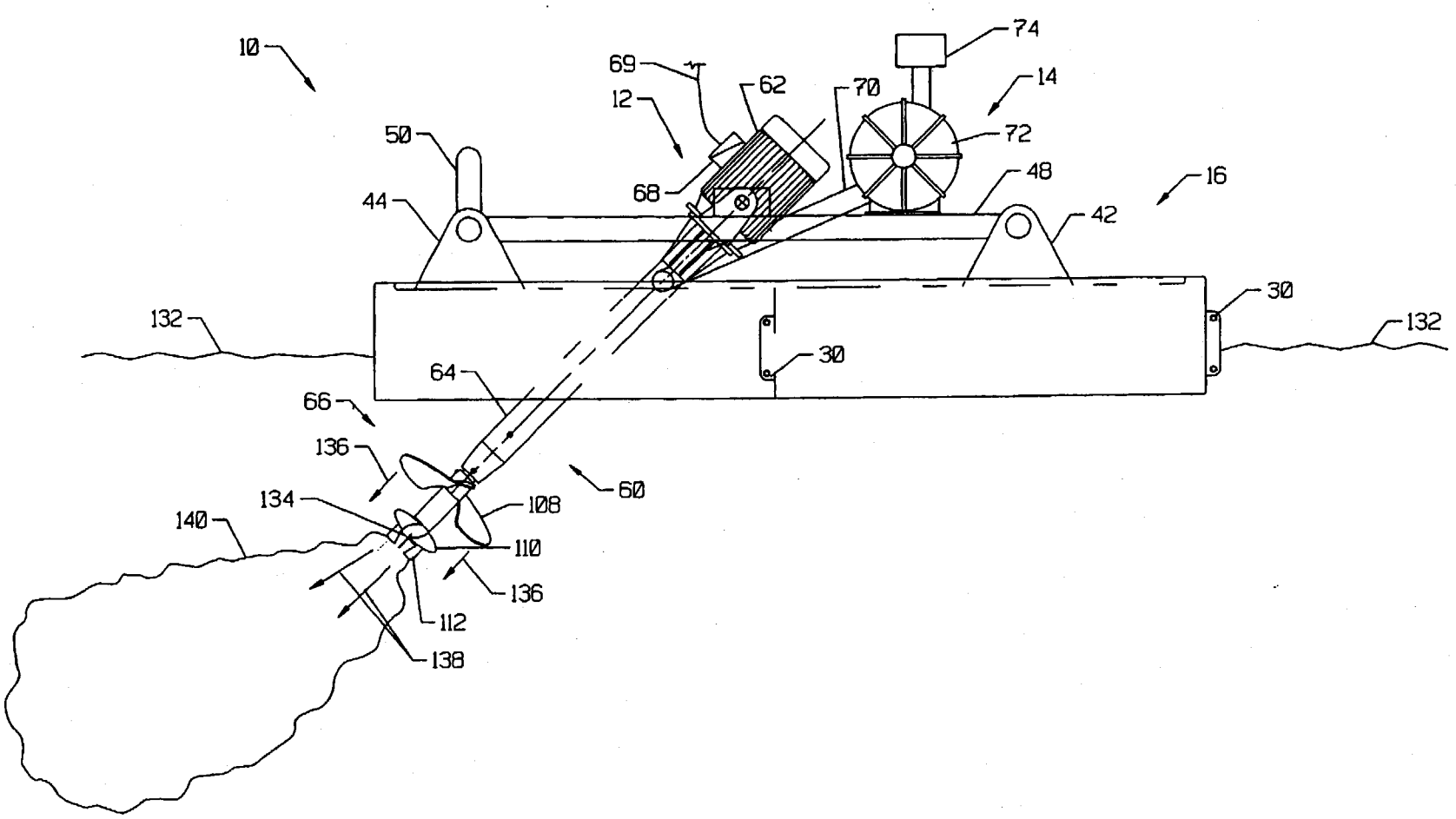
FIG. 5 is a side elevational view showing the aeration apparatus of FIG. 1 in operation.

Referring to FIG. 5, the aeration system 10 in accordance with the present invention is shown in operation. The aeration system 10 is located within a water basin for treatment of water 132 contained therein. Float support structure 16 floats on the surface of the water 132, supporting aerator 12 and compressed air source 14. The aerator 12 propeller system 66 is disposed within water 132 at a desired angle. When in an operational position, aerator 12 may be operated in selected modes of operation for performing a desired process, such as a mixer for a nitrification/de-nitrification process or an air assisted aerator.

In one preferred mode of operation, the aeration system 10 in accordance with the present invention is operated as an air-assisted propeller driven aspirated aerator. The aerator 12 operates with compressed air source 14 for maximum aeration and oxygenation efficiency. The aerator 12 is adjusted to the desired angle of operation relative to float support structure 16. Motor 62 is energized to rotate primary propeller 108 (through drive shaft 84) at a relatively low velocity. Rotating primary propeller 108 at a relatively low velocity operates the propeller 108 as a mixer of water 132, indicated by flow arrows 136. Compressed air source 14 provides air through drive shaft 84 to the aeration process. The amount of air received from compressed air source 14 is fully adjustable. In particular, compressed air source 14 provides compressed air to aerator 12 through flexible air hose 70. Air passes through housing 86 at opening 88. As drive shaft 84 rotates, air enters the hollow drive shaft 84 through air intake hole 94, and exits the propeller system 66 at air outlet 134.

The secondary propeller 110 is used to diffuse the main flow of water 132 to a gently directed flow towards the atomizer 112, indicated by flow arrows 138. The atomizer 112 mixes the directed flow with the compressed air exiting the air outlet 134. The atomizer 112 shapes the air exiting air outlet 134 into fine atomized bubbles for efficiently increasing the dissolved oxygen content in the water 132. The fine atomized bubbles, indicated by atomization cloud 140, prolong the bubble hang time within water 132 allowing less air to escape to the surface of the water 132 and correspondingly a greater oxygen transfer rate to the water 132.

The compressed air source 14 air pressure and/or volume, the propeller system 66 velocity, and the mounting angle of aerator 12 are fully adjustable to achieve maximum efficiency and oxygenation performance of aeration system 10. Further, the location of the atomizer 112, secondary propeller 110 and primary propeller 108 may be adjusted to be located at a predetermined distance along the line of flow for maximum performance of the propeller system 66 and corresponding oxygen transfer rate.

The unique design of the aeration system in accordance with the present invention provides for efficient mixing and/or transfer of oxygen, improving the dissolved oxygen content of water receiving treatment. The aerator of the present invention requires less energy consumption corresponding to a desired oxygen transfer rate, since the propeller system no longer requires to be operated at a very high velocity rate required to create the vacuum to draw air through the aerator shaft as required in conventional type aeration systems. Further, the aeration system 10 in accordance with the present invention may be operated in connection with a fluid treatment control system, making the performance characteristics fully automatically adjustable through automatic adjustment of the aerator 12 angled relative to the support structure 16, adjusting air supplied by compressed air source 14, and adjusting the operation velocity of propeller system 66.

The velocity of propeller system 66 may be increased, creating a vacuum proximate atomizer 12, allowing aerator 12 to be used as conventional aspirator aerator as known in the art, without the assistance of compressed air. It is recognized that the pressure of the air located within drive shaft 84 may be approximately equal to the pressure present at air outlet 134. Alternatively, the pressure of air located within drive shaft 84 may be greater or less than the pressure present at air outlet 134 as selectively desired for specific aerator performance.

In another mode of operation, aerator 12 is used solely as a mixer in a nitrification/de-nitrification process without the introduction of outside air or compressed air. By energization of motor 62, drive shaft 84 rotates primary propeller 108 at a desired speed and angle to provide the desired amount of mixing and movement of water 132 for the nitrification/de-nitrification process.

It will be understood that this disclosure is, in many respects, only illustrative. Changes may be made in details, particularly in matters of shape, size, material, and arrangement of parts without exceeding the scope of the invention. Accordingly, the scope of the invention is as defined in the language of the appended claims.

What is claimed is:

1. A method of treating waste water, comprising the steps of:

providing an aerator/mixer including an elongate drive shaft having a first end a second end, the first end being coupled to a selectively rotatable power source, a compressed air source in fluid communication with a tubular shaft; a first propeller coupled to the drive shaft proximate the drive shaft second end; a second propeller, larger than the first propeller, coupled to the drive shaft between the first propeller and the first end of the drive shaft;

submerging the second end of the drive shaft and the propellers in waste water;

delivering air to the second end of the drive shaft from the compressed air source when the propellers are rotating to aerate the waste water; and reducing the delivery of air to the second end of the drive shaft from the compressed air source when the propellers are rotating to mix the waste water.

2. The method in accordance with claim 1, wherein air is delivered to the second end of the drive shaft from the compressed air source when the propellers are rotating to mix the waste water.

3. The method in accordance with claim 1, further comprising the step of orienting the drive shaft at an acute angle to the surface of the waste water.

* * * * *